United States Patent [19]

Sullivan

[11] Patent Number: 4,474,497

[45] Date of Patent: Oct. 2, 1984

[54] FURNACE MAINTENANCE PLATFORM

[75] Inventor: Robert P. Sullivan, Chattanooga, Tenn.

[73] Assignee: Combustion Engineering, Inc., Windsor, Conn.

[21] Appl. No.: 485,100

[22] Filed: Apr. 14, 1983

[51] Int. Cl.[3] ..... F27D 23/00

[52] U.S. Cl. ..... 432/76; 122/379; 122/510; 122/DIG. 14; 182/128

[58] Field of Search ..... 110/181, 336, 349; 122/361, 379, 493, 494, 510, DIG. 14; 432/3, 76; 182/128

[56] References Cited

U.S. PATENT DOCUMENTS 3,420,332 1/1969 Textor ..... 182/128

4,221,537 9/1980 Mamula et al. ..... 432/3

4,232,636 11/1980 Prohazka ..... 182/128

4,276,956 7/1981 Mamula et al. ..... 182/128

*Primary Examiner*—Edward G. Favors

*Assistant Examiner*—Steven E. Warner

*Attorney, Agent, or Firm*—Robert L. Olson

[57] ABSTRACT

A maintenance platform for reaching the upper area of the furnace (10) of a steam generator that can be quickly and easily assembled during a maintenance shutdown. The grid or frame of the platform is made up of a plurality of beams (22) extending into the furnace from opposite furnace walls (19). Cables (50) from the roof (60) support one end of the beams. Planking (66, 68) that interlocks (62, 64, 70) with the beams (22) completes the platform.

2 Claims, 8 Drawing Figures

FURNACE MAINTENANCE PLATFORM

BACKGROUND OF THE INVENTION

This invention is directed to a maintenance platform to permit access to the upper region of the furnace of a steam generator. During scheduled maintenance shutdowns of a steam generator, it often becomes necessary to gain access to the upper region of the furnace. One reason for this need might be the removal of slag from pendant superheaters which may not be completely removed by the soot blowers. Presently on large units, the only way to reach this area by workmen is to build scaffolding from the furnace bottom on up. In large units, one hundred feet or more in height, the expense of constructing the scaffolding is prohibitive. Moreover, many days are required to construct the scaffold, necessitating lengthy downtime of the steam generator.

SUMMARY OF THE INVENTION

In accordance with the invention, a maintenance platform is provided for reaching the upper area of the furnace of a steam generator. This platform can be quickly and easily assembled during a regularly scheduled maintenance shutdown so that a minimum amount of time is required. The platform is simply constructed, keeping the cost minimal. The entire cross-sectional area of the furnace beneath the superheaters can be platformed, or only a skeleton platform to certain areas can be put up, whichever is required. The framework of the platform is supported both from the furnace walls, and also from the furnace roof.

DESCRIPTION OF THE PREFERRED EMBODIMENT

Figure 1:
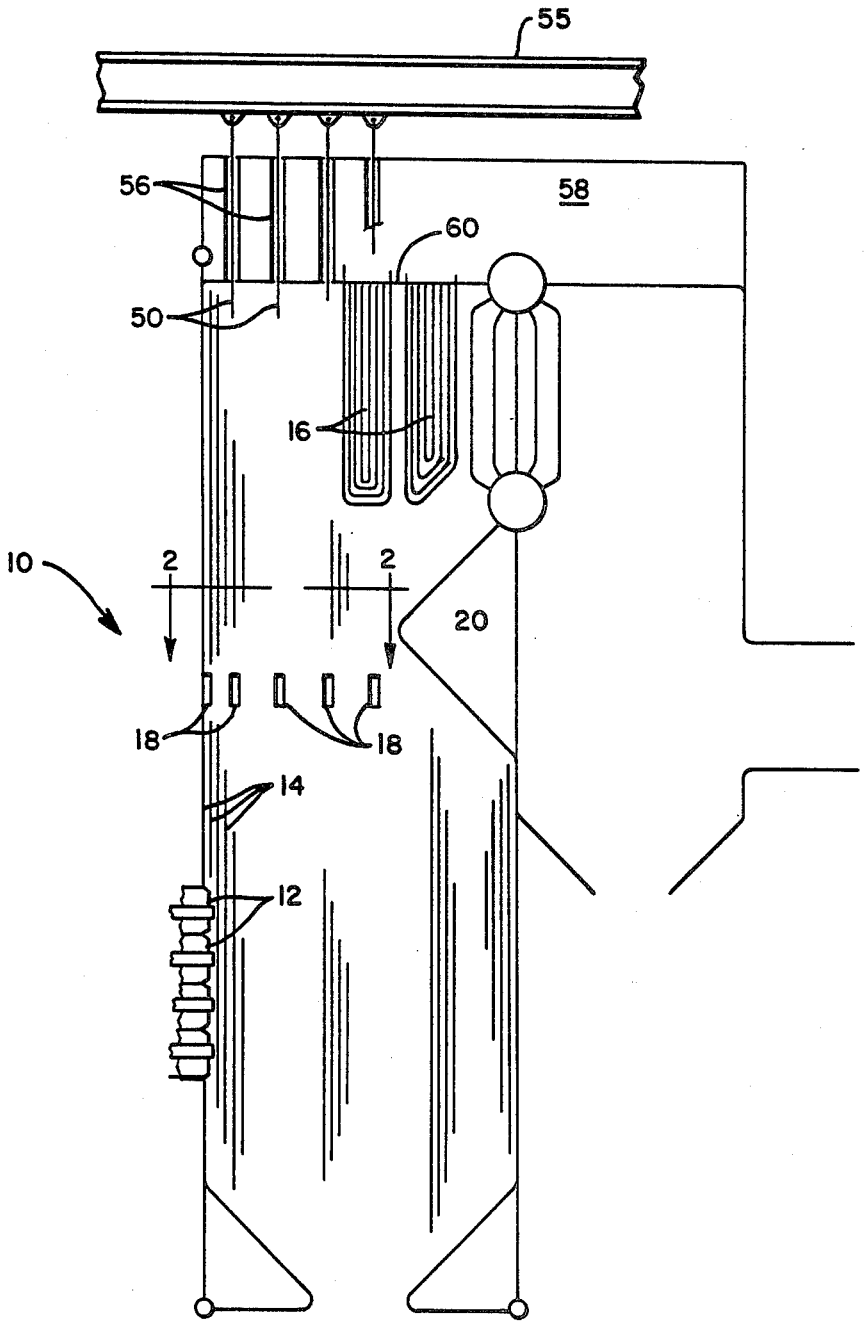
FIG. 1 is a sectional elevation of the furnace of a steam generator.

Looking now to FIG. 1, the furnace 10 of a steam generator is shown in which burners 12 are provided for burning coal therein. The walls of the furnace are lined with water-cooled tubes 14, and in the upper portion of the furnace is located pendant superheaters 16. During regularly scheduled maintenance shutdowns, it sometimes is necessary for workmen to gain access to the upper portion of the furnace, for example to remove slag from the superheater panels.

Figure 2:
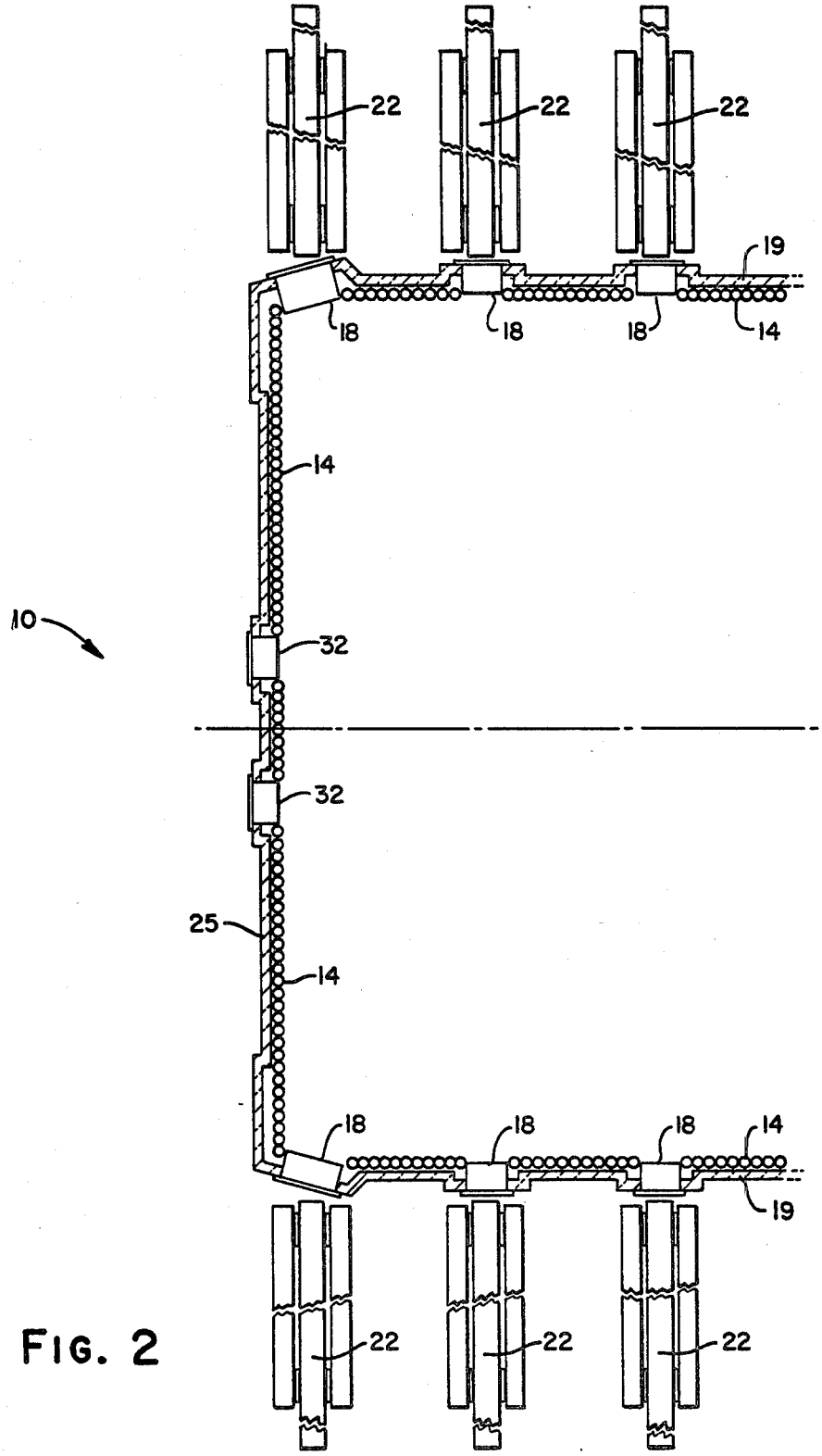
FIG. 2 is a view taken on line 2—2 of FIG. 1.
Figure 3:
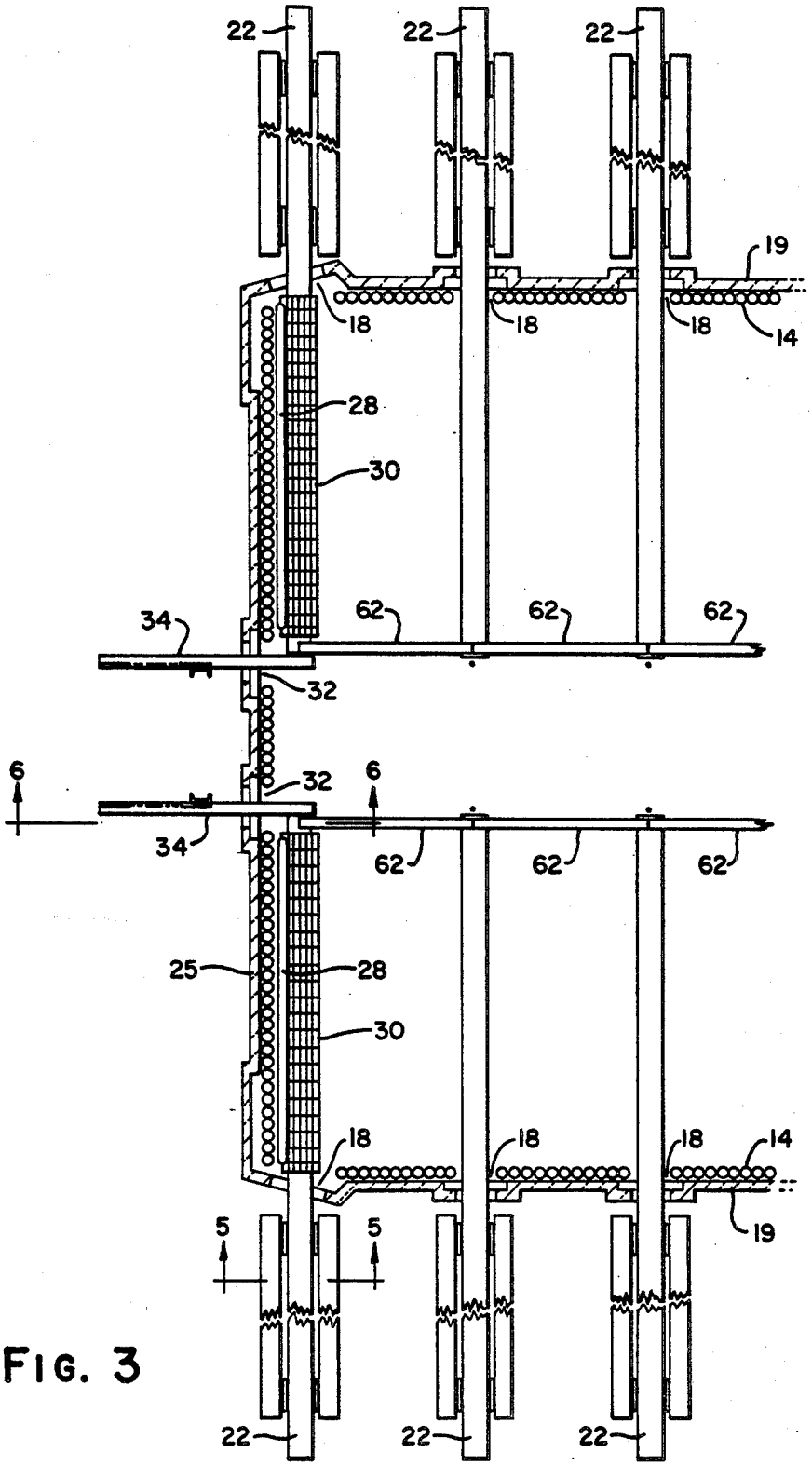
FIG. 3 is a view similar to FIG. 2, with the platform framework in place in the furnace.
Figure 4:
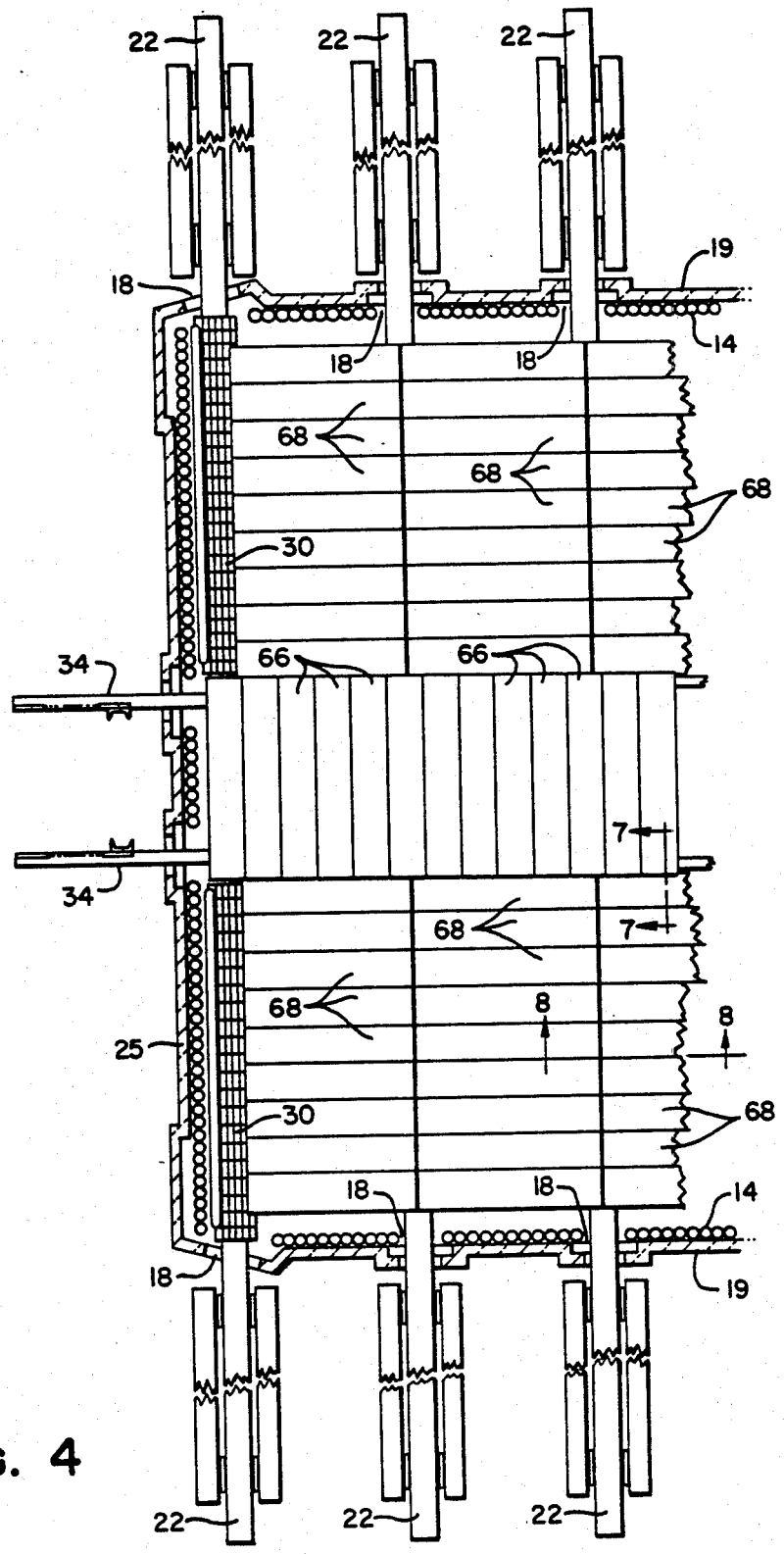
FIG. 4 is a view similar to FIGS. 2 and 3, with the platform fully assembled within the furnace.

As shown in FIGS. 1-4, there are a plurality of openings 18 along each side 19 of the furnace 10, at about the height of the nose arch 20, just beneath the superheaters 16. These openings would be covered by removable doors during normal operation of the boiler. During a maintenance shutdown, the doors are removed so that the platform framework can be placed in the furnace and assembled. As shown in FIG. 2, a plurality of beams 22 can be moved into and out of the furnace by means of upper and lower rollers 24 and 26 (FIG. 5), the lower rollers 26 being power driven. These beams 22, when fully extended into the furnace, reach to a point close to the center of the furnace (FIG. 3), and form the major portion of the maintenance platform framework.

Figure 5:
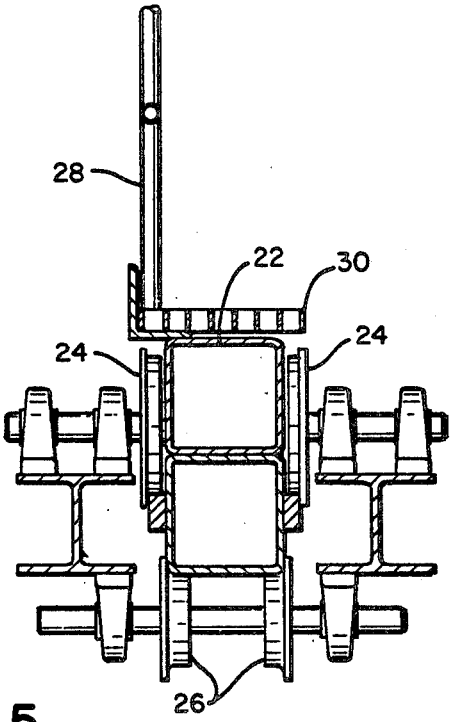
FIG. 5 is a view taken on line 5—5 of FIG. 2.
Figure 6:
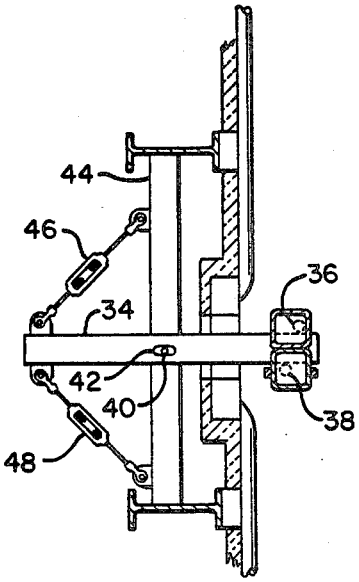
FIG. 6 is a view taken on line 6—6 of FIG. 2.

As seen in FIG. 5, the beams 22 closest to the furnace front wall 25 have attached thereto a handrail 28 and a grate 30. These are the only beams containing this added equipment. This enables a workman to initially get out onto this beam to assemble the rest of the platform in relative safety. There are a pair of doorways 32 (FIGS. 2-4) in the front wall of the furnace, which doorways are aligned with the end of beams 22 when they are fully extended into the furnace. These openings permit a locking beam 34 to be inserted into the furnace, which beam slides between the rolls 36 and 38 (FIG. 6), thus supporting and stabilizing the end of beam 22. Once the beam 34 has been properly positioned relative to rolls 36 and 38, a pin 40 is placed in opening 42, locking it to channel member 44. The turnbuckle members 46 and 48 can also be pinned to the channel member 44, and the turnbuckles can then be tightened to firmly hold beam 34 in place.

Figure 7:
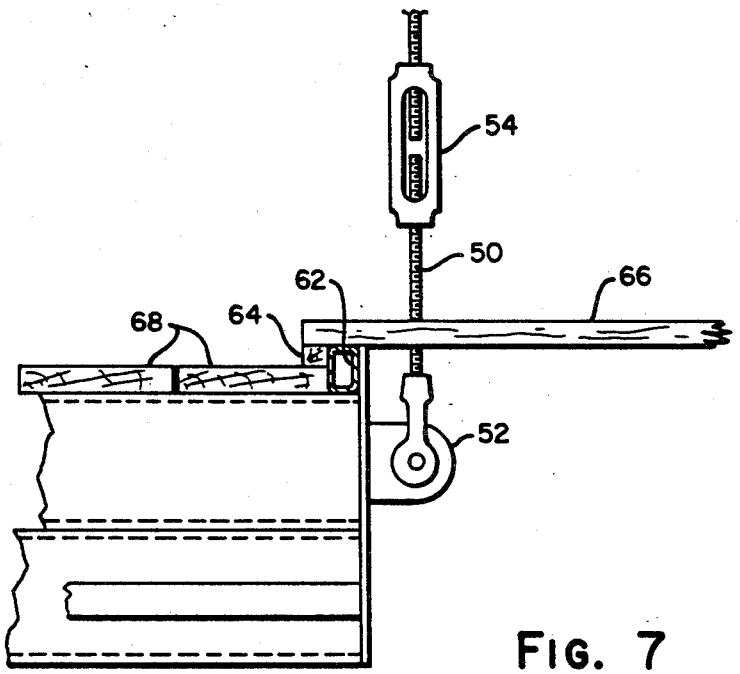
FIG. 7 is a view taken on line 7—7 of FIG. 4.

At this point in time, a workman can enter the furnace along the beam 22 located next to the front wall. A plank or two can be placed between this beam 22 and the next adjacent beam 22, so that the worker can move out onto this next beam. The workmen can attach cable 50 to the lug 52 which is welded to the end of beam 22 (FIG. 7). Turnbuckle 54 can then be adjusted to level the beam 22. The cables 50, there being one for the end of each of beams 22 other than the beams adjacent the front wall, can be dropped into the furnace prior to the workmen entering therein. These cables are attached at their upper ends to support steel 55 (FIG. 1), and extend through sleeves 56, which are anchored in the doghouse 58 of the furnace 10 above the furnace roof tubes 60. Once the cable is properly attached to the end of the first beam 22, the workmen can place a couple of more planks over to the next beam and repeat the procedure. This can be repeated as often as necessary until the ends of all of the beams 22 on both halves of the furnace are supported by cables. The workmen can then place the structural tubing members 62 (FIG. 3) between the ends of each beam 22, and bolt them to each beam. The purpose of these structural tubing members 62 is twofold. First, they tie the ends of all of the beams 22 together, giving the framework added rigidity and preventing relative lateral movement of these beam ends. Secondly, they form a ledge, which coacts with a complementary ledge 64 on planks 66 (FIG. 7), preventing these planks from slipping off of the ends of the beams 22.

Figure 8:
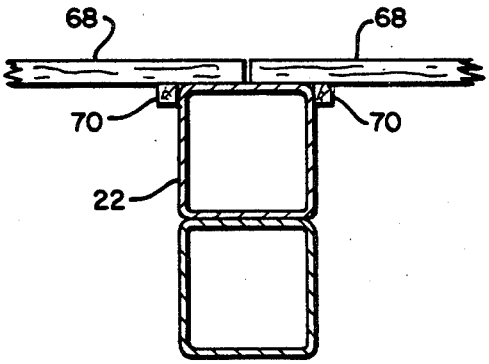
FIG. 8 is a view taken on line 8—8 of FIG. 4.

After the tubing members 62 have been secured in place, the only thing left to do is to place the planks 66 and 68 in position (FIGS. 7 and 8). Planks 68 have ledges 70 attached to them which coact with the edges of the beams 22 to lock them in place, preventing them from slipping out of the framework. After placement of the planks 66 and 68, any number of workers can safely enter the upper furnace area to accomplish whatever maintenance work is necessary. When this is accomplished, the temporary platform can be quickly disassembled, the doors can again be secured to the openings 18 and 32 in the furnace, and the unit can be placed back into operation.

What is claimed is:

1. A furnace having four enclosing walls and a roof, with steam generating tubes lining the walls, steam superheating tubes extending down into the furnace from the roof, a plurality of openings extending along opposite walls of the furnace at an elevation subjacent to the superheating tubes, a plurality of adjacent first beams, one each of said first beams having an inner end and an outer end and extending into the furnace through each one of the openings from opposing sides, the outer end of each first beam being supported outside of the furnace, a plurality of cables extending down from the furnace roof, the inner end of each first beam being supported by one of the cables, each cable containing a turnbuckle close to the first beams, which turnbuckles can be adjusted so as to support the first beams in a relative horizontal position, second beams extending perpendicularly between the respective inner ends of the first beams on an opposing side, and being secured to the upper surfaces thereof, so as to tie all of the first beam inner ends together on an opposing side, and boards extending between each adjacent first beams, and between each of the second beams across from each other, so that a platform is formed which covers substantially the entire cross-section of the furnace.

2. The furnace set forth in claim 1, including ledge means secured to the ends of all of the boards, by means of which both ends of each board are held securely between the beams supporting it.

* * * * *